United States Patent [19]

Roberts

[11] 4,135,893

[45] Jan. 23, 1979

[54] MIXING METHOD AND DEVICE

[75] Inventor: Alan G. Roberts, Dorking, England

[73] Assignee: Cogas Development Company, Princeton, N.J.

[21] Appl. No.: 486,501

[22] Filed: Jul. 8, 1974

[51] Int. Cl.[2] ..... B01D 53/00

[52] U.S. Cl. ..... 55/82; 48/202; 137/7

[58] Field of Search ..... 48/202; 134/7; 55/77, 55/82, 262, 390, 468

[56] References Cited

U.S. PATENT DOCUMENTS

| | | | |
|---|---|---|---|
| 3,236,045 | 2/1966 | Betgea et al. | 55/468 X |
| 3,440,177 | 4/1969 | Patton et al. | 252/373 |
| 3,782,913 | 1/1974 | Donath | 48/202 |
| 3,879,180 | 4/1975 | Hutgens et al. | 55/83 |

*Primary Examiner*—John Adee

*Attorney, Agent, or Firm*—Nilton Zucker; Robert D. Jackson

[57] ABSTRACT

A method and apparatus for mixing coal char particles with a hot stream of combustion gases containing molten ash particles, in order to prevent build-up of ash in the apparatus. The coal char particles, fluidized with a gas, are discharged as an annulus about the stream of combustion gases, so that the molten ash particles are cooled and solidified by progressive mixing with the char particles and thus prevented from reaching the walls of the apparatus in a molten state.

1 Claim, 1 Drawing Figure

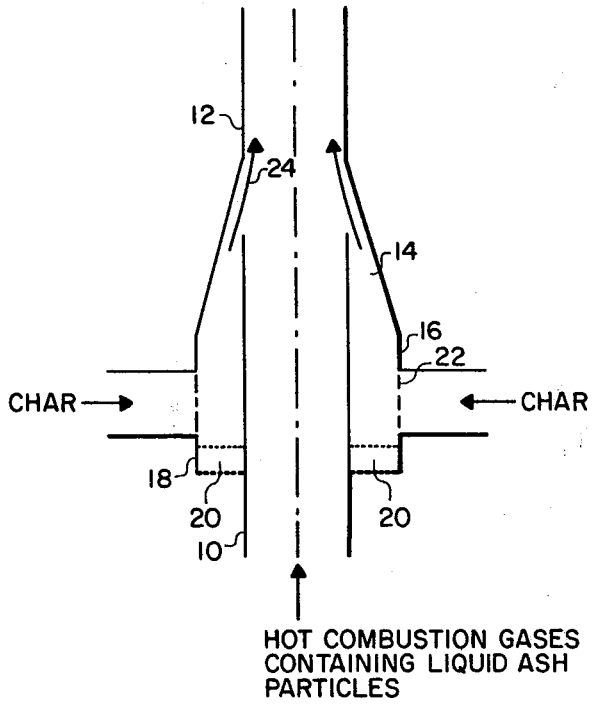
12
24
14
16
22
CHAR
CHAR
18
20
20
10
HOT COMBUSTION GASES
CONTAINING LIQUID ASH
PARTICLES

MIXING METHOD AND DEVICE

This invention relates to the gasification of carbon with steam, and particularly to such processes in which a recirculating stream of carbon is heated externally of the gasifier to provide the heat necessary for gasification.

The gasification of carbon with stem to produce synthesis gas is a very old process. The reaction $C + H_2O \rightarrow CO + H_2$ is endothermic, and heat is required for the process.

One method for supplying heat to the process is described in Patton et al U.S. Pat. No. 3,440,177 issued Apr. 22, 1969. The gasifier is a fluidized bed reactor using preferably coal char fluidized with steam; the heat is provided by burning a portion of the char in an external heater, and entraining a recycle stream of char from the bed in the hot combustion gases from the burning char, the heat of the combustion gases being used to heat the recycle stream to a temperature sufficiently high to provide the heat of reaction in the gasifier.

An improvement in the Patton et al process is set forth in United Kingdom Pat. No. 1,312,860 granted 8/8/73 to the FMC Corporation in which the char fines from the external cyclone of the gasifier are burned in the external heater. Char fines are so buoyant that they will not remain in the fluidized bed but are carried out of the top of the gasifier vessel along with the product gas. By using the fines as fuel, the process of the FMC patent converts an economic loss into a comparable gain. The temperature of the products of the combustion of the char fines is above that at which the ash melts and most of the ash is removed as molten slag. However a small fraction of the ash is carried with the hot flue gas. Entrainment of the recycle solids in this gas reduces its temperature so that any ash with it solidifies and may build-up on the walls of the tube in which entrainment takes place; this build-up would interfere with operation of the apparatus and require frequent shutdowns for cleaning.

In accordance with the instant invention, a solution to the solids build-up problem aforesaid is provided by discharging the extremely hot flue gases, at a temperature at which ash in the flue gas is molten, into an annulus of fluidized recycle char, and entraining the annulus of fluidized char into the flue gas, whereby the molten particles of ash are cooled and solidified by progressive mixing with the char and thus prevented from reaching the walls of the entrainment tube in the molten state.

The single figure drawing is a schematic cross-section of the apparatus used in practicing the invention.

In the process, with which this invention is most useful, coal char is gasified with steam in a fluidized bed and the gasification heat requirements are supplied by withdrawing char from the bed, heating it in suspension in a stream of the gaseous products of the combustion of char from a slagging combustor and returning the heated char, after separation from the combustion gas, to the fluidized gasification bed.

The requirements of the means of feeding char into the stream of hot combustion gas include:

(a) The rate of feed must be controllable, varying the quantities of air supplied for fluidizing it both in the space, surrounding the point of injection into the lift tube and in the slightly inclined transfer section.

(b) The products of combustion leaving the combustor will be at a temperature above that at which any ash particles will be in the form of molten slag droplets and the walls of the duct will have a film of molten slag on them. After mixing the temperature of the combustion gas will be reduced and that of the char increased towards a temperature at which the slag particles will be solid. In the intermediate range of temperatures slap particles will be in a state in which, if they contract the walls of the duct, they are likely to adhere and build-up to form solid or sintered deposits, that would prevent the satisfactory operation of the process. Hence the means for mixing must prevent slag particles reaching the walls until mixing has reduced their temperature sufficiently to render the particles nonadhesive. Similarly, the ash in the char particles near the walls must not rise in temperature above the point at which they are adhesive.

(c) The quantity of any gas used for promoting the flow of char should be minimzed to conserve high temperature heat.

(d) The use of cooled surfaces should be minimized.

(e) The rate of mixing of char and hot gas should be as rapid as possible consistent with the requirements mentioned in (b) to minimize the length of lift tube required for the gas and char to reach substantially the same temperature.

Apparatus and method are provided in accordance with the invention herein for feeding char at a controllable rate into a conveying-heating lift tube in a manner that gives, in the zone above the point of injection of char when dispersion of the char in the stream of gas passing up the lift tube is taking place, higher concentrations of char adjacent to the walls than towards the center of the lift tube. Thus, if the temperature of the gas supplied to the lift tube is above that at which any ash particles it may contain are molten and the temperature of the dispersion after the gas and char have mixed and reached substantially the same temperature is below the ash fusion temperature, droplets of ash in the gas or ash particles in the char will be unlikely to reach the walls of the lift tube in a liquid or adhesive condition and the walls of the lift tube above the point of injection of char will be kept at a temperature lower than would be the case if the concentration of char in the gas flowing adjacent to them were not higher than towards the center of the tube. In addition the construction of the walls in the zone may incorporate means for cooling by water circulated through suitable conduits. These effects on the temperature of the walls of the lift tube and of ash particles near them minimize the danger of the accumulation of deposits of ash.

Apparatus useful for obtaining this result is shown in the drawing. A tube 10 contains the hot combustion gases from a slagging combustor, at a temperature at which the ash particles are liquid. The walls of the tube 10 will have some liquid ash running back into the combustor; they never get cold enough for the ash to solidify. The tube 10 discharges into a lift tube 12 preferably concentric with the tube 10. The tube 12 has at its base a frustoconical section 14 which terminates in a cylindrical section 16, at the base of which is a grid 18 through which a fluidizing gas stream 20 enters. Char at about 1800° F enters the chamber formed by the cylinder 16 through openings 22 all about the base of the cylinder; the char enters the lift tube 12 as an annulus 24 of fluidized char about the stream of combustion gases. Thus, the molten ash in the combustion gases hits the char before it hits the walls, and is largely cooled to below its adhesive point before it can contact the inner wall of the lift tube 12. Appropriate cooling devices may be used to control temperature; it is desirable to insulate the device to prevent heat losses; the lift tube is preferably lined with cooled refractory rings in conventional fashion to prevent damage from the high heat and scouring action of the char particles; and appropriate shutoff valves are provided for use in shutdowns.

These and other changes may be made without departing from the scope of the invention as defined in the claims.

What is claimed is:

1. In the method of gasifying carbon with steam in a fluidized bed, in which the heat of gasification is supplied by a recycling stream of carbon which is heated externally of the bed by being entrained in a lift tube in a hot stream of combustion gases containing molten ash particles, the improvement which comprises feeding the hot stream of combustion gases centrally into the lift tube while feeding a stream of recycle carbon into the lift tube so as to provide an annulus of fluidized recycle carbon initially surrounding the stream of combustion gases, whereby the molten ash particles mix with the recycle carbon and are thereby cooled and solidified before they reach the tube wall so that they do not adhere to and buildup in said tube wall.

* * * * *